US012151799B2

(12) United States Patent
Berry

(10) Patent No.: US 12,151,799 B2
(45) Date of Patent: Nov. 26, 2024

(54) REMOTE GUIDANCE FOR ROWING SHELLS

(71) Applicant: Robert G. Berry, Sarasota, FL (US)

(72) Inventor: Robert G. Berry, Sarasota, FL (US)

( * ) Notice: Subject to any disclaimer, the term of this patent is extended or adjusted under 35 U.S.C. 154(b) by 449 days.

(21) Appl. No.: 17/565,809

(22) Filed: Dec. 30, 2021

(65) Prior Publication Data

US 2023/0211865 A1 Jul. 6, 2023

(51) Int. Cl.
*B63H 25/38* (2006.01)
*B63H 25/14* (2006.01)

(52) U.S. Cl.
CPC ..... *B63H 25/38* (2013.01); *B63H 25/14* (2013.01)

(58) Field of Classification Search
CPC ..... B63H 25/04; B63H 25/14; B63H 25/38; B63H 2025/028; G05D 1/00
USPC ..... 114/162; 701/21
See application file for complete search history.

(56) References Cited

U.S. PATENT DOCUMENTS

| | | | | |
|---|---|---|---|---|
| 8,287,323 | B2 * | 10/2012 | Hine | B63H 19/04 440/9 |
| 8,376,790 | B2 * | 2/2013 | Hine | B63H 19/04 440/9 |
| 8,695,520 | B1 * | 4/2014 | Berte' | B63H 9/06 114/39.27 |
| 9,524,646 | B2 * | 12/2016 | Hine | F03B 13/1815 |
| 10,005,526 | B2 * | 6/2018 | White | B63B 3/38 |
| 10,875,613 | B2 * | 12/2020 | Vining | A01M 29/24 |

* cited by examiner

*Primary Examiner* — Daniel V Venne
(74) *Attorney, Agent, or Firm* — Donald R. Boys; Central Coast Patent Agengy LLC

(57) ABSTRACT

A system for guiding a first watercraft remotely has a rudder proximate the stern of the first watercraft, having a rudder shaft extending upward from a deck area at the stern, a servo device having an output servo horn coupled to the rudder shaft by a linkage, adapted to turn the rudder shaft in concert with the servo horn, a radio receiver/controller adapted for receiving radio signals for guiding the first watercraft, the radio receiver/controller coupled to the servo device, and a radio transmitter having an input wheel for providing steering commands. The system is characterized in that the input wheel of the radio transmitter is manipulated by a user remote from the watercraft, the radio signals for guiding the first watercraft are transmitted from the radio transmitter to the radio receiver/controller on the first watercraft, and the radio receiver/controller provides operating signals to the servo device to rotate the servo horn either clockwise or counterclockwise, guiding the first watercraft.

20 Claims, 8 Drawing Sheets

REMOTE GUIDANCE FOR ROWING SHELLS

BACKGROUND OF THE INVENTION

1. Field of the Invention

The present invention is in the technical area of remote-control apparatus and methods and pertains in particular to remote rudder control for such as racing shells.

2. Description of Related Art

Racing shells, being relatively long and narrow boats adapted for rowing, are well-known in the art. There are many models known, such as single-person shells, two-person shells, and so on. In some instances, the shell will have a rudder with a handle which may be manipulated by a coxswain, and in other instances, the rower or rowers may manage direction for the shell by manipulating the paddles in a manner to change direction. In all cases, to manage direction for a shell it is necessary that the person or person managing is able to see the direction of the shell and able to focus on one or more reference points.

Because of the need to see to guide a shell, in the current art the sport of boat racing is limited to sighted persons, and not open to those without good eyesight.

What is clearly needed is apparatus whereby a sighted person in a separate boat may control direction for a rowing shell operated by sight-challenged persons.

BRIEF SUMMARY OF THE INVENTION

In one embodiment of the invention a system for guiding a first watercraft remotely is provided, comprising a rudder proximate the stern of the first watercraft, having a rudder shaft extending upward from a deck area at the stern, a servo device having an output servo horn coupled to the rudder shaft by a linkage, adapted to turn the rudder shaft in concert with the servo horn, a radio receiver/controller adapted for receiving radio signals for guiding the first watercraft, the radio receiver/controller coupled to the servo device, and a radio transmitter having an input wheel for providing steering commands. The system is characterized in that the input wheel of the radio transmitter is manipulated by a user remote from the first watercraft, the radio signals for guiding the first watercraft are transmitted from the radio transmitter to the radio receiver/controller on the first watercraft, and the radio receiver/controller provides operating signals to the servo device to rotate the servo horn either clockwise or counterclockwise, guiding the first watercraft.

In one embodiment the system further comprises a mounting plate joined to the deck area at the stern, upon which mounting plate the rudder shaft, the rudder, and the servo device are mounted, and a waterproof container holding a battery pack as a power supply for the system and the radio receiver/controller, the waterproof container having an output port coupled by a three-wire cable to the servo device, providing the operating signals to the servo device. Also, in one embodiment the mounting plate is a hinged mounting plate available from McMaster Carr™. In one embodiment the mounting plate and the waterproof container are joined to the deck area by conventional fasteners. And in one embodiment the system further comprises cut pieces of 3M™ Dual-Lock™ reusable fastener material, joined to the deck area at the stern of the first watercraft and to the underside of both the mounting plate and the waterproof container, whereby the mounting plate and mounted elements and the waterproof container are joined to and removed from the first watercraft.

In one embodiment of the system the rudder and the rudder shaft are permanently installed in the first watercraft, the servo device is mounted on the mounting plate, and the radio receiver/controller and a battery pack are provided in a waterproof container. Also, in one embodiment the mounting plate and the waterproof container are joined to the deck area by conventional fasteners. Also, in one embodiment the mounting plate, the waterproof container and the deck area have cut pieces of 3M™ Dual-Lock™ reusable fastener material adhered by adhesive, whereby the mounting plate with the servo device and the waterproof container may be joined to and removed from the first watercraft. In one embodiment the system further comprises a second water craft, wherein the user manipulating the radio transmitter follows the first watercraft while providing guidance signals to the first watercraft. In one embodiment the first watercraft is a rowing shell.

In another aspect of the invention a method for guiding a first watercraft remotely is provided, comprising connecting an output servo horn of a servo device to a rudder shaft connected to a rudder, the rudder shaft and rudder proximate the stern of the first watercraft, by a linkage adapted to turn the rudder shaft in concert with the servo horn, sending guidance signals to a receiver/controller on the first watercraft from a radio transmitter having an input wheel, the radio transmitter operated by a user remote from the first watercraft, and guiding the first watercraft by sending operating signals to the servo device from the receiver/controller.

In one embodiment the method further comprises mounting the rudder shaft, the rudder, and the servo device joined to the rudder shaft by linkage, to a mounting plate, and placing the radio receiver/controller in a waterproof container also holding a battery pack as a power supply for the system, the waterproof container having an output port coupled by a three-wire cable to the servo device, providing the operating signals to the servo device, and mounting the mounting plate and the waterproof container to a deck area at the stern of the first watercraft. Also in one embodiment the mounting plate is a hinged mounting plate available from McMaster Carr™, further comprising mounting the rudder shaft, the rudder, and the servo device joined to the rudder shaft by linkage, to the McMaster Carr™ mounting plate. In one embodiment the method further comprises securing the mounting plate and the waterproof container to the deck area by conventional fasteners. And in one embodiment the method further comprises adhering, by adhesive, cut pieces of 3M™ Dual-Lock™ reusable fastener material to the deck area at the stern of the first watercraft and to the underside of both the mounting plate and the waterproof container, whereby the mounting plate and mounted elements and the waterproof container are joined to and removed from the first watercraft.

In one embodiment the rudder and the rudder shaft are permanently installed in the first watercraft, and the method further comprises mounting the servo device on the mounting plate and placing the radio receiver/controller and a battery pack in a waterproof container. In one embodiment the method further comprises joining the mounting plate and the waterproof container to the deck area by conventional fasteners. Also, in one embodiment the method further comprises joining cut pieces of 3M™ Dual-Lock™ reusable fastener material to the mounting plate, the waterproof container and the deck area by adhesive, and joining and removing the mounting plate with the servo device and the waterproof container from the first watercraft. In one embodiment the method further comprises a second water craft, further comprising the user manipulating the radio transmitter providing guidance signals to the first watercraft while following the first watercraft in the second watercraft. And in one embodiment the first watercraft is a rowing shell, and the method further comprises guiding the rowing shell for a sight-challenged person operating the rowing shell.

DETAILED DESCRIPTION OF THE INVENTION

Figure 1:
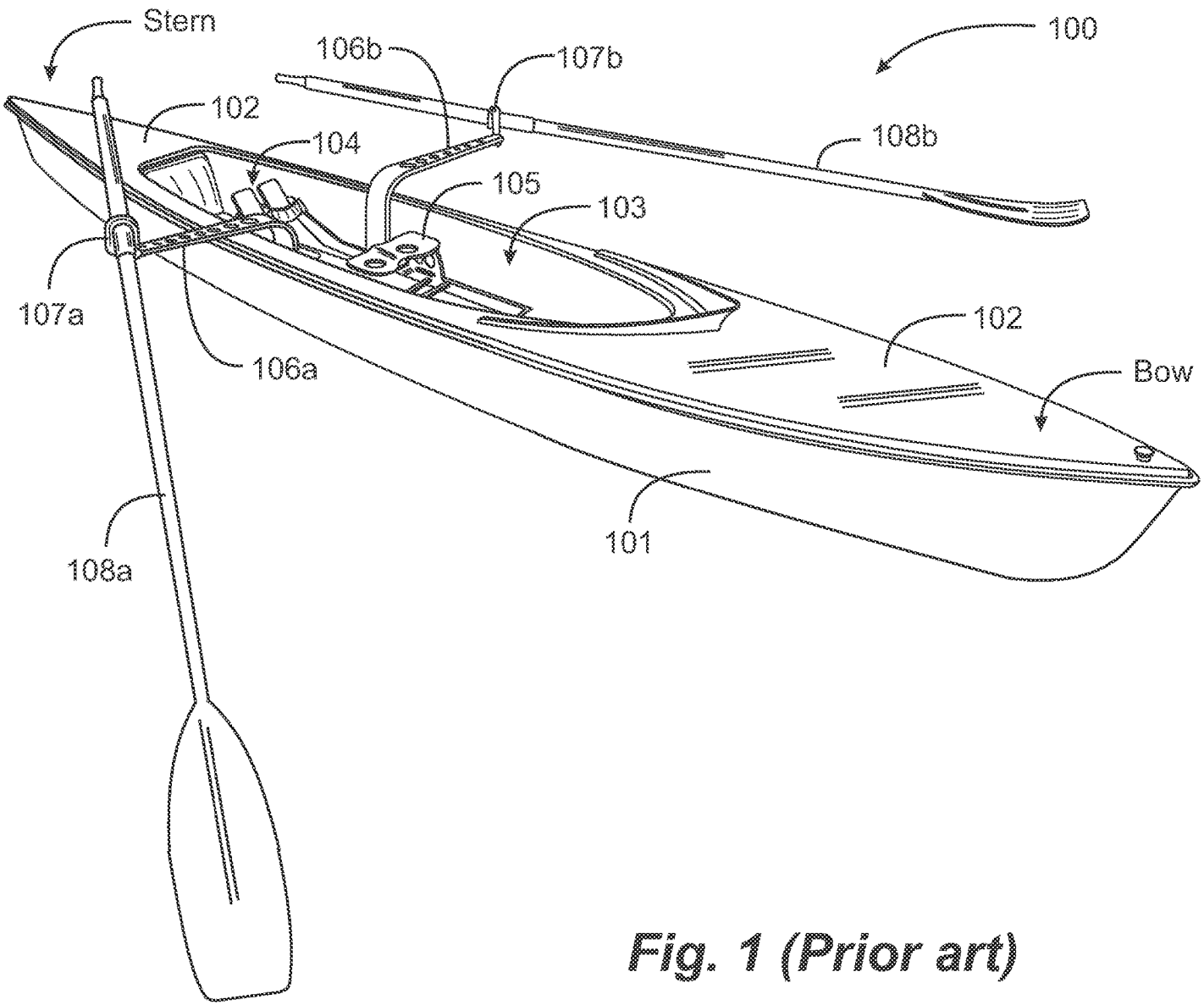
Fig. 1 (Prior art)
FIG. 1 is a perspective view of a rowing shell according to an embodiment of the present invention.

FIG. 1 is a perspective view of a rowing shell 100 according to an embodiment of the present invention. Shell 100 is a one-person shell and is mean to be representative of a wide variety of rowing shells that might be utilized in various embodiments of the invention.

Shell 100 in this example comprises a hull 101 covered with a deck 102 into which a cockpit 103 is implemented. The shell has a bow and a stern as shown in the figure. A pair of foot stirrups 104 is mounted to the hull in the cockpit and provides an anchor for a user's feet with the user sitting on a seat 105 that is mounted on a track such that as the user pushes with the feet and pulls on the oars, the seat may progress forward with a rowing stroke, and backward as the user returns the oars to start another stroke.

Oars 108*a* and 108*b* are mounted in collars 107*a* and 107*b* at the outboard ends of bars 106*a* and 106*b* that extend from the hull. The user sits on seat 105 facing toward the stern to operate the shell. Typically, the user will focus on one or more reference points to guide the shell.

Figure 2:
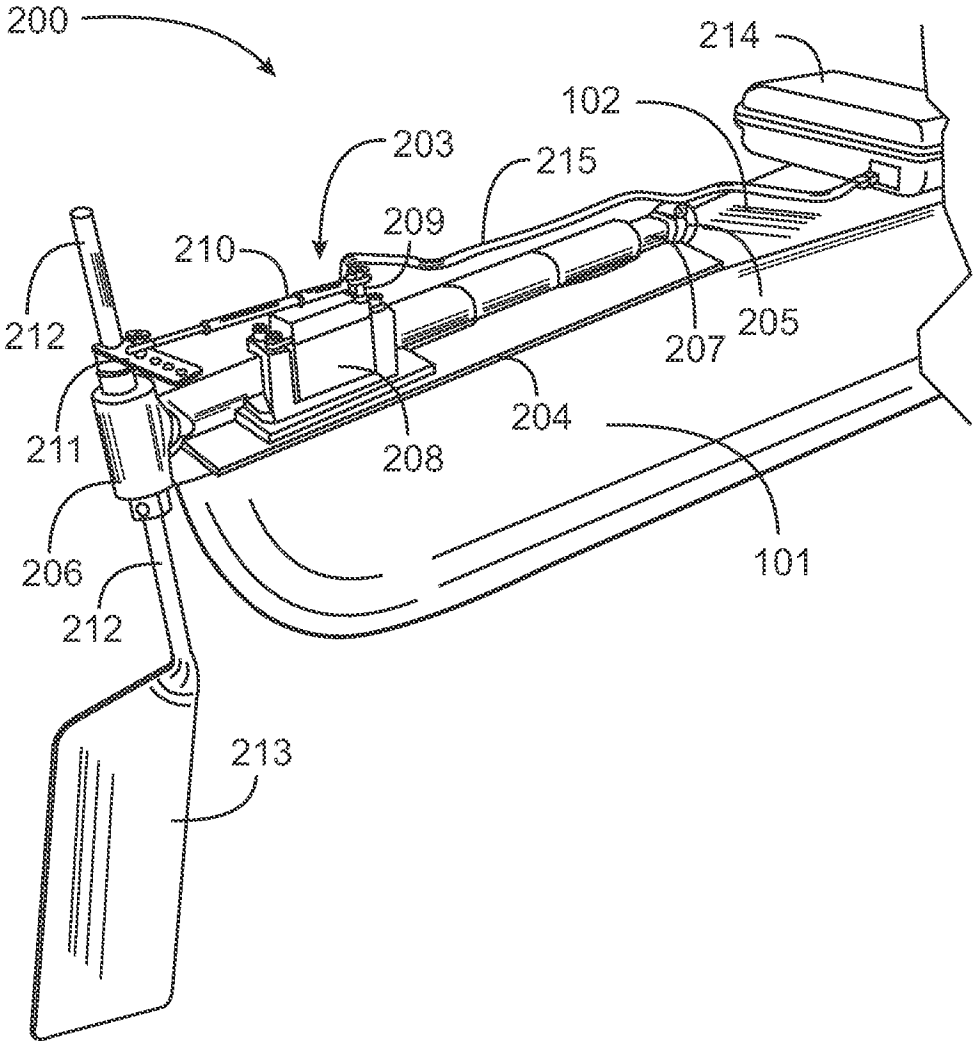
FIG. 2 is a perspective view of an apparatus added to a stern of the shell of FIG. 1 in an embodiment of the invention.

FIG. 2 is a perspective view of a shell 200 that has been fitted with apparatus 203 to enable a third person to guide shell 200, as a user, who may be sight challenged, rows. Shell 200 has hull 101 and deck 102. The deck shown in truncated FIG. 2 is at the stern of shell 200.

In FIG. 2 a remote steering apparatus 203 is illustrated as mounted to deck 102 at the stern of shell 200. Apparatus 203 comprises in this example a mounting base 204, which in one embodiment may be a metal plate, such as an aluminum plate, cut to accommodate the width of the deck at the stern of shell 200. In the example illustrated in FIG. 2 base 204 is a hinged mounting plate available from McMaster Carr. The hinged plate is available in different sizes and is selected for proper length and width to accommodate the particular shell that is to be configured with remote steering.

In the example illustrated by FIG. 2 a bearing housing 206 is joined to a shaft 207 that is sized to fit through the hinge as shown. Bearing housing 206 has internal bearing through which a rudder shaft 212 is assembled and held by collars on the rudder shaft. Bearing housing 206 may rotate on shaft 207 around the axis of the hinge and when positioned so that rudder shaft 212 is vertical, is constrained to remain so by a clamp collar 205.

Rudder shaft 212 is welded to a rudder plate 213 in this example. In other embodiments the rudder plate may be mounted, for example, by conventional screw fasteners. A servo unit 208 is mounted on plate 204, in this example by adhesive, but may be mounted and constrained in other ways. Servo 208 has a horizontally oriented server horn 209 on a vertically oriented output shaft, and server horn 209 is joined to a similar arm 211 extending from rudder shaft 212 by a linkage 210 that is adjustable in length. As the servo is activated to rotate its output shaft in either rotary direction link 210 moves arm 211, and the rudder shaft is rotated to move rudder 213 to steer the shell.

In this example a watertight container 214 houses a controller and receiver along with a set of batteries as a power supply. The receiver tracks radio communications from a Tactic TTX300 3 channel radio device that has a rotary input for varying a signal to the controller to manage signals to the servo. The radio device, which is operated by the third person mentioned above that may follow the shell in a separate boat, is described in more detail below. The controller communicates with servo 208 on a three-wire cable 215 that plugs into the controller through an interface on the watertight container 214.

In one embodiment apparatus 203 is permanently mounted to the stern deck of the shell to be guided. In another embodiment apparatus 203 may be an aftermarket unit that may be added to an existing shell and removed when the shell is no longer needed to be remotely guided.

Figure 3:
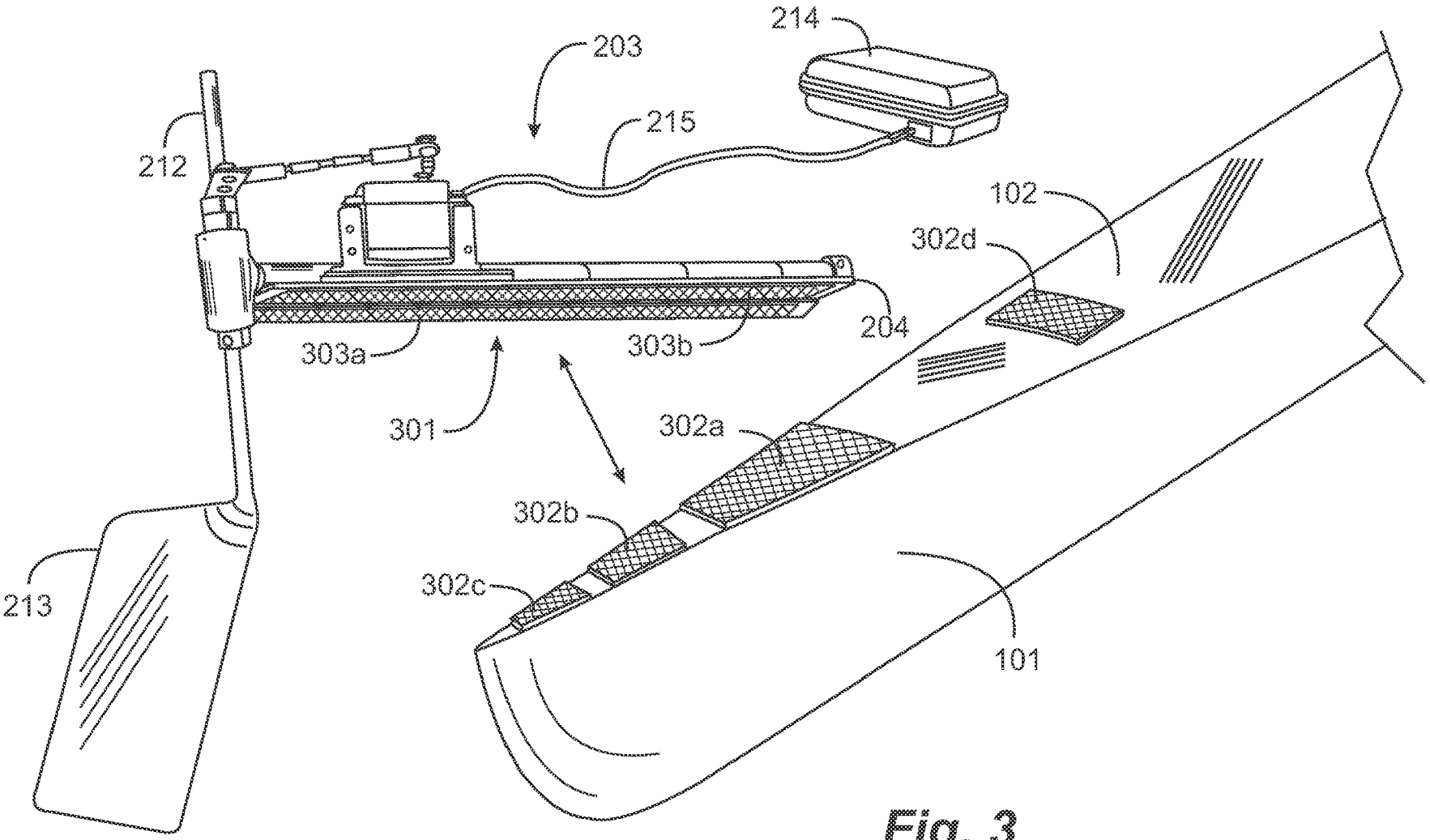
FIG. 3 is a perspective view illustrating joining of the apparatus of FIG. 2 to the deck of a shell in an embodiment of the invention.

FIG. 3 is a perspective view of apparatus 203 separated from shell 100. Apparatus 203 is rotated enough around the longitudinal axis that underside 301 of the hinged mounting plate is visible. Four shaped pieces of 3M™ Dual-Lock™ reusable fastener material, labeled 302*a*, 302*b*, 302*c* and 302*d* are illustrated as joined to deck 102 by suitable high-strength adhesive. The Dual-Lock™ material comprises a dense plurality of mushroom-shaped protrusions, such that two pieces with the protrusions facing may be urged together such that the protrusions lock together, strongly joining the two pieces.

The underside surfaces of hinged mounting plate 204 are provided also with shaped pieces 303*a* and 303*b* of the Dual-Lock™ material, mounted by adhesive. In this example, apparatus 203 may be placed on deck 102 with corresponding pieces of the Dual-Lock™ material facing, and the apparatus may be urged toward the deck until the Dual-Lock™ material snaps together, strongly joining the apparatus to the deck. The apparatus may be removed as desired by pulling the apparatus from the deck, separating the pieces of Dual-Lock™ material. In this manner apparatus 203 is an aftermarket apparatus that may be added to the stern deck of just about any rowing shell. Piece 302*d* of the Dual-Lock™ material is for mounting container 214 which has a corresponding piece of the material adhered on the underside.

It should be noted that the mounting as described above is not a limitation in the invention. The apparatus may be joined to the deck of a rowing shell by, for example, drilling holes in the mounting plate and joining the apparatus to the deck of the shell with conventional screw fasteners.

Figure 4:
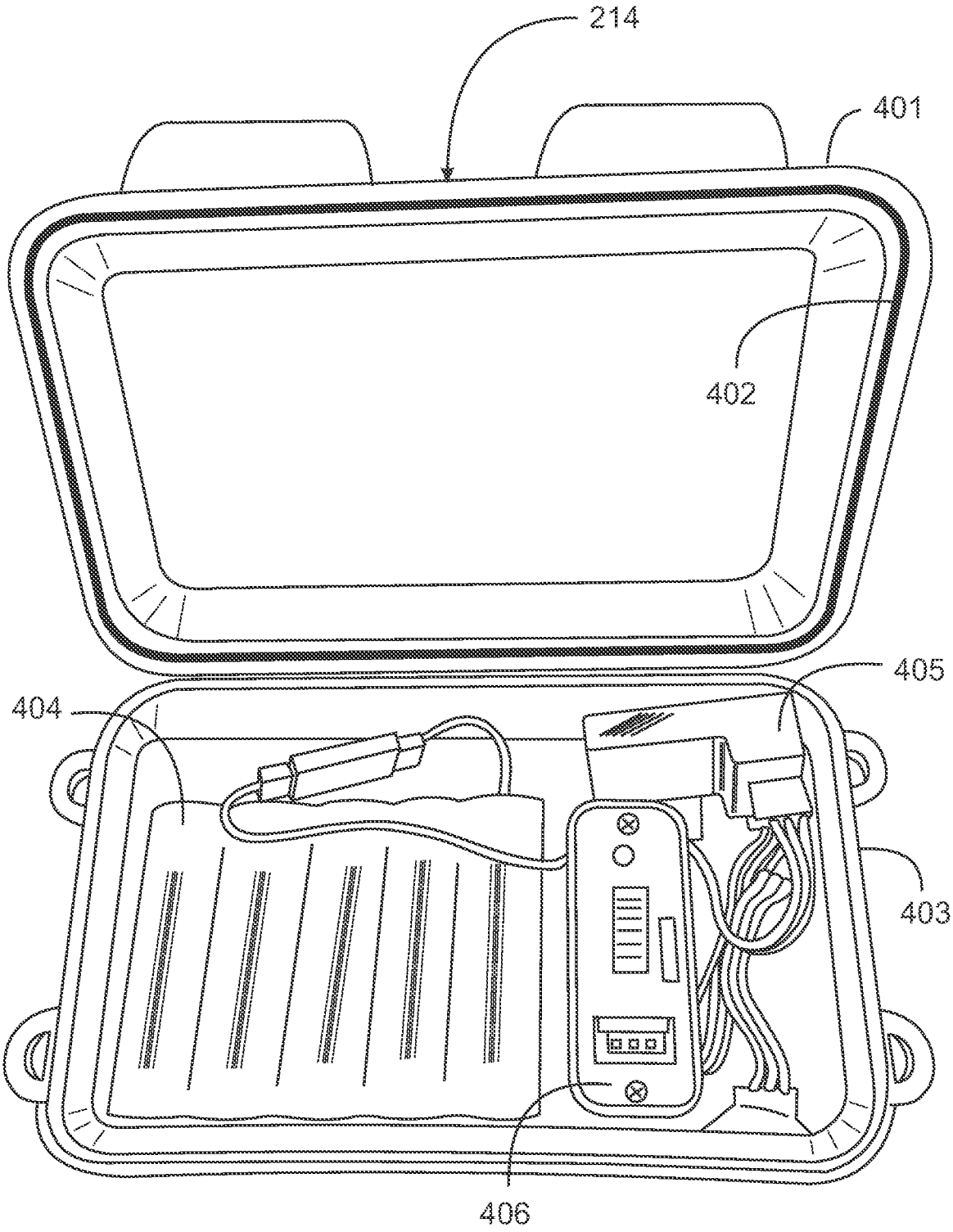
FIG. 4 is a perspective view of a watertight container with electrical elements in an embodiment of the invention.

FIG. 4 is a perspective view of watertight container 214 with a lid 401 open showing a battery pack 404, an on-off switch 406 and a receiver/controller 405 that are carried in the container in this example. Receiver/controller 405 pairs with a remote radio controller 501 illustrated in FIG. 5. In the present example receiver/controller 405 is a Tactic TTX300 3-Channel 2.4 GHz SLT Radio System w/TR325 TACJ0300, although in some other embodiments a different remote control radio unit may be suitable.

Figure 5:
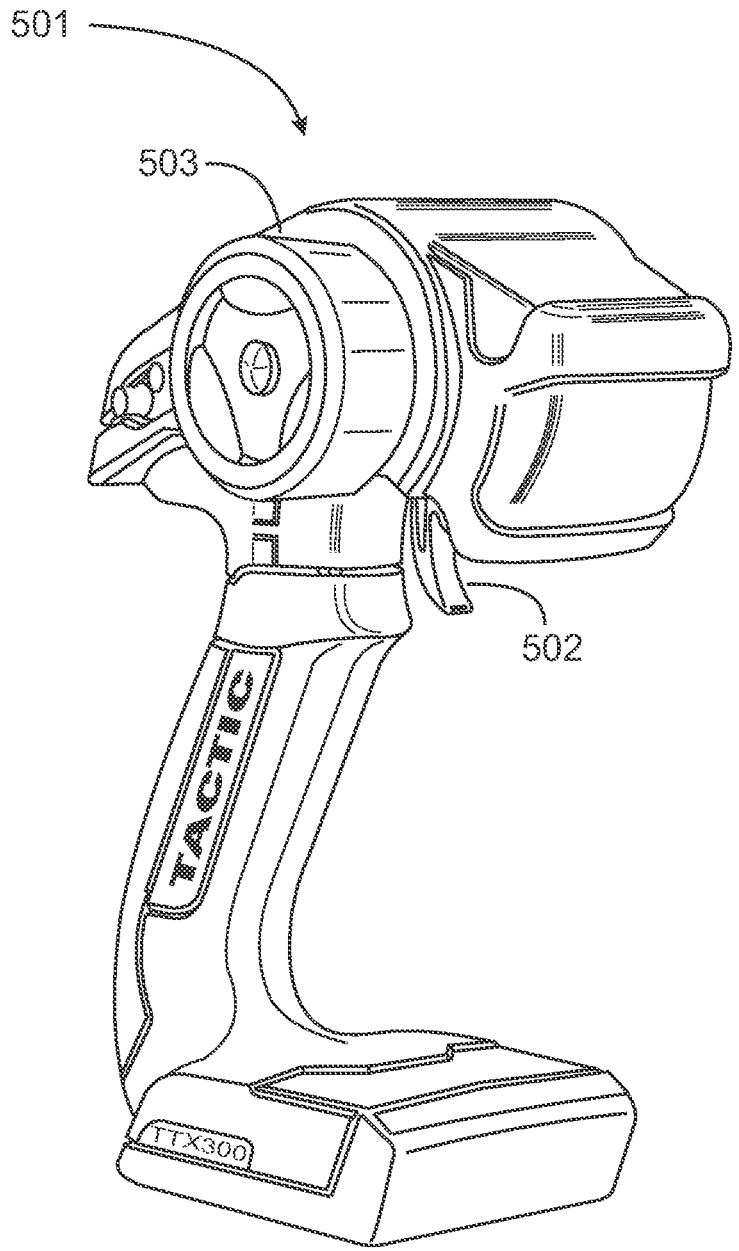
FIG. 5 is a perspective view of a radio remote controller used in an embodiment of the invention.

FIG. 5 illustrates radio controller 501, which is a pistol-grip apparatus with a trigger 502 and an input wheel 503. Radio controller 501 has a battery for power. A user, who may be in a boat following a shell to be guided, turns input wheel 503 clockwise or counterclockwise to signal the apparatus on the shell. Signals from radio controller 501 go to receiver/controller 405, which is a device that is sold with radio controller 501, receiver/controller 405 is connected from container 214 to servo 208 by cable 215 (see FIG. 2). The output shaft of servo 208 is connected by linkage 210 in a manner as described above with reference to FIG. 2, such that the user with radio controller 501 may turn rudder 213 in either rotary direction to guide the shell carrying apparatus 203.

Figure 6:
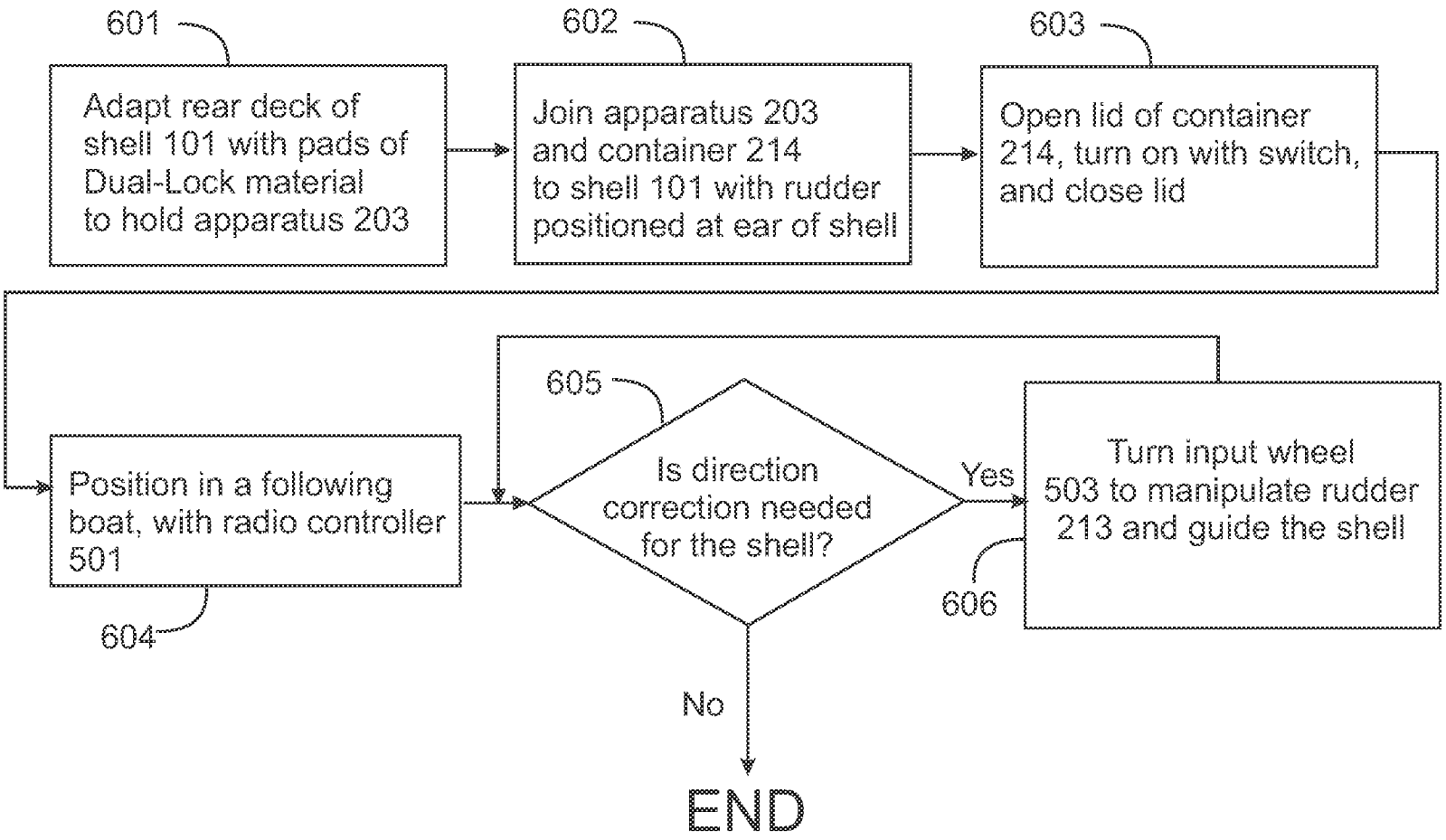
FIG. 6 is a flow diagram illustrating a process in an embodiment of the invention.

FIG. 6 is a flow diagram illustrating an exemplary process in adapting a shell for a sight-challenged rower and operating the apparatus to guide the shell. At step 601 a user adapts a rowing shell for remote guidance by adhering pads of Dual-Lock™ material to the stern deck of the shell in appropriate positions to hold apparatus 203. The shell may be a one-person shell, as used as an example in this specification, but mat be essentially any sort of rowing shell.

At step 602 an assembled apparatus 203, having pads of Dual-Lock™ material adhered to a bottom surface of a mounting plate of the apparatus, is urged onto the rear deck of the shell, causing the Dual-Lock™ pads to lock together, firmly joining the apparatus to the shell. The rudder in this step is positioned to be in the water at the rear of the shell.

At step 603 a lid of container 214 of the apparatus is opened, and On switch 406 is thrown to initiate the system, then the lid is closed again. At step 604 the user positions herself in a separate boat to follow the shell to be guided, holding remote radio controller 501. The following boat may be powered and operated by a third party or may be operated by the user with the radio controller. The user follows and monitors the shell and determines at step 605 if a correction in the direction of the shell is needed. If correction is needed the user, at step 606 turns input wheel 503 to operate the rudder of the apparatus added to the shell. Input wheels 606 operates as a steering wheel in the system. As each correction is made action loops back through step 605 until no further guidance is needed, at which time the process is ended.

Embodiments described above this far are aftermarket systems that may be added to essentially any rowing shell, to enable remote direction control by a person other than the person rowing the shell. A principal use of embodiments of the invention is to enable blind and otherwise sight-challenged rowers to exercise and to compete in rowing races. An advantage of the aftermarket system is that it may be added and removed from any rowing shell. In some circumstances, however, a shell may have an existing rudder permanently mounted at the stern of the shell.

Figure 7:
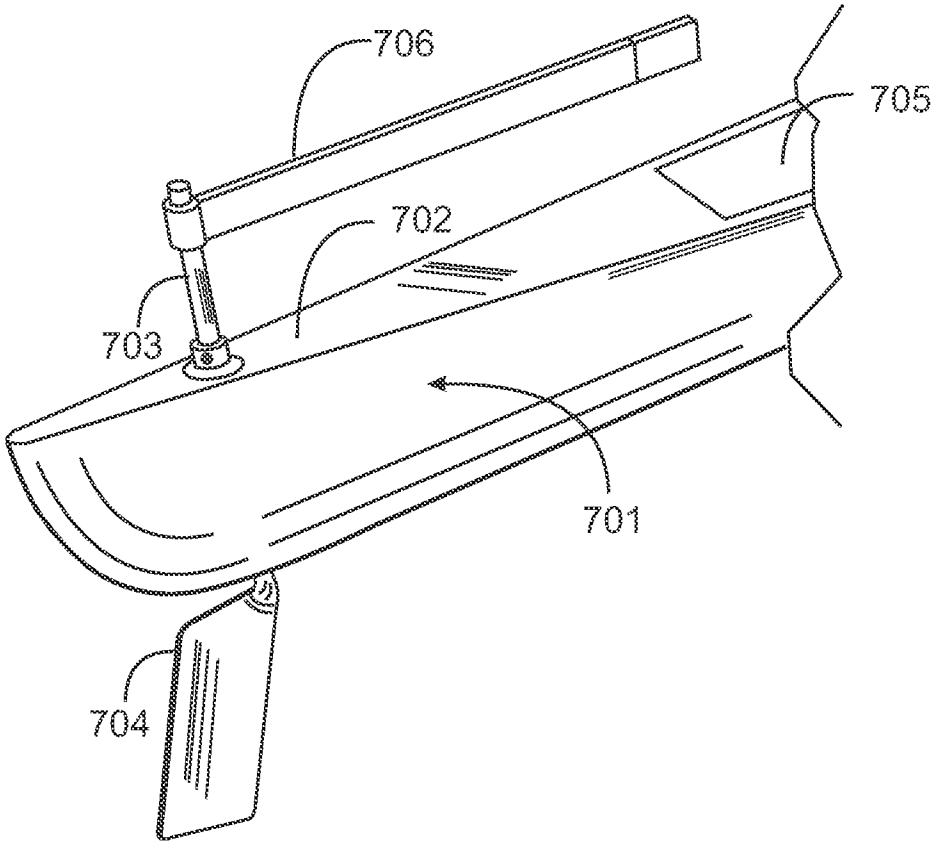
Fig. 7 (Prior art)
FIG. 7 is a perspective view of a shell with an existing rudder.

FIG. 7 illustrates a shell 701 with a stern deck in which a rudder 704 is implemented on a rudder shaft 703 that passes through the stern deck and through the keel of the shell, in a sealed tube. The rudder may be manipulated in a number of different ways, such as by a handle 706 joined to the rudder shaft above the deck and extending to the cockpit 705, where a coxswain may operate the rudder to guide the shell. There are other ways the rudder may be implemented.

Figure 8:
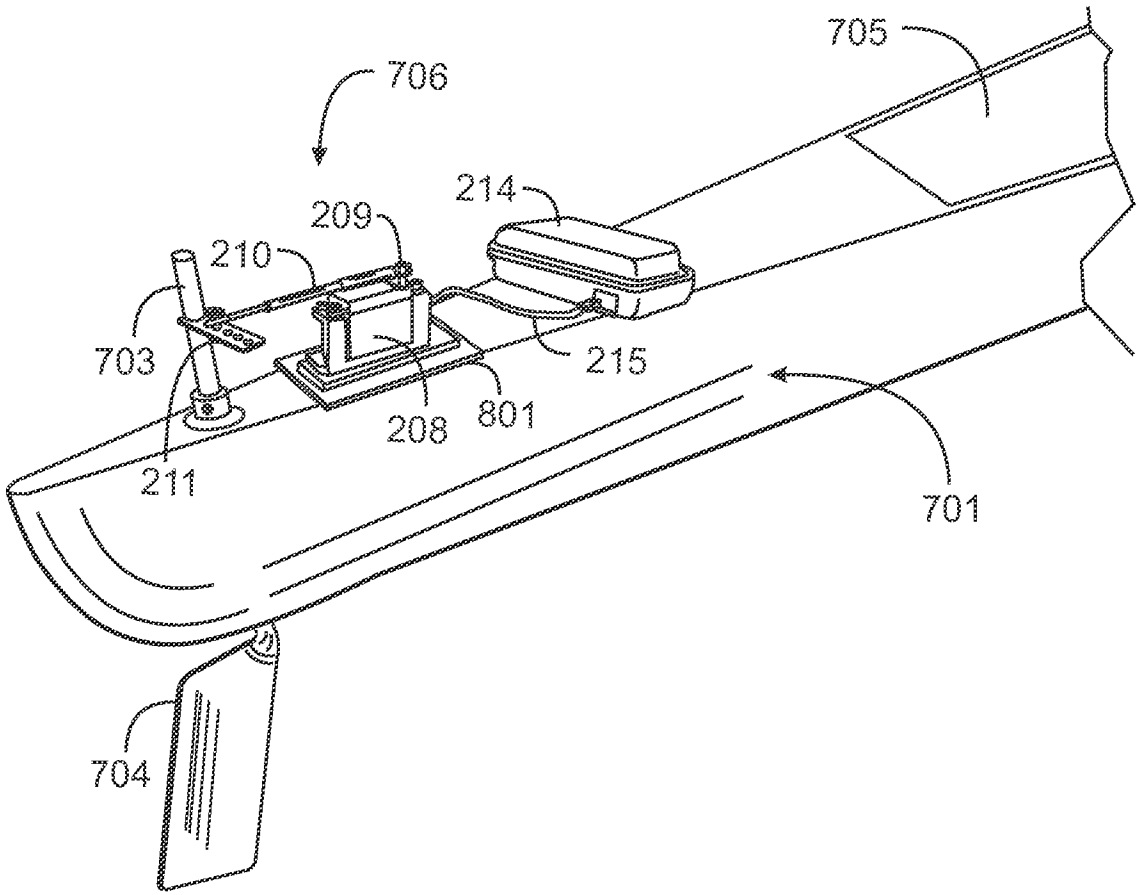
FIG. 8 is a perspective view of the shell of FIG. 7 with an apparatus installed according to an embodiment of the invention.

FIG. 8 illustrates shell 701 of FIG. 7 with an apparatus 706 similar to apparatus 203 adapted to the stern deck and to the rudder shaft. Apparatus 706 shorter than apparatus 203, and does not include the hinged mounting plate 204, bearing housing 206, rudder shaft 212 or rudder 213. Apparatus 706 uses a flat mounting plate 801, that may be metal, plastic or other suitable material. Apparatus 706 attaches arm 211 to the existing rudder shaft 703 to turn existing rudder 704. In other respects, apparatus 706 has similar elements and functions as apparatus 203. Patches of Dual-Lock™ material are adhered to deck 702 and to underside of both mounting plate 801 for apparatus 706 and waterproof container 214. Operation is the same as described above for apparatus 203.

As described briefly above, the apparatus 203 may be applied to any shell or other watercraft that has no rudder, and the apparatus 706 may be applied and adapted to a watercraft that has an existing rudder and rudder shaft. A person operation radio controller 501 to steer a watercraft enabled by either apparatus 706 or apparatus 203 may be in a following boat. The person operating the radio controller may, however, be in the watercraft that is adapted with one or the other apparatus according to an embodiment of the invention. It is well known that some rowing shells are equipped with rudders that are operated by an on-board coxswain. In one embodiment of the invention the rudder and rudder shaft of such a shell may be adapted with an apparatus 706, and the coxswain may operate the rudder by carrying and using radio controller 5101. In this embodiment radio controller 501 functions as a sort of steering wheel for the shell.

The invention claimed is:

1. A system for guiding a first watercraft remotely, comprising:

a rudder proximate a stern of the first watercraft, having a rudder shaft extending upward from a deck area at the stern;

a servo unit having a servo horn coupled to the rudder shaft by a linkage, adapted to turn the rudder shaft in concert with the servo horn;

a radio receiver/controller adapted for receiving radio signals for guiding the first watercraft, the radio receiver/controller coupled to the servo unit; and a radio controller having an input wheel for providing steering commands;

characterized in that the input wheel of the radio controller is manipulated by a user remote from the first watercraft, the radio signals for guiding the first watercraft are transmitted from the radio controller to the radio receiver/controller on the first watercraft, and the radio receiver/controller provides operating signals to the servo unit to rotate the servo horn either clockwise or counterclockwise, guiding the first watercraft.

2. The system of claim 1 further comprising a mounting plate joined to the deck area at the stern, upon which mounting plate the rudder shaft, the rudder, and the servo unit are mounted, and a waterproof container holding a battery pack as a power supply for the system and the radio receiver/controller, the waterproof container having an output port coupled by a three-wire cable to the servo unit, providing the operating signals to the servo unit.

3. The system of claim 2 wherein the mounting plate is a commercially available hinged mounting plate.

4. The system of claim 2 wherein the mounting plate and the waterproof container are joined to the deck area by conventional fasteners.

5. The system of claim 2 further comprising cut pieces of reusable fastener material, joined to the deck area at the stern of the first watercraft and to the underside of both the mounting plate and the waterproof container, whereby the mounting plate and mounted elements and the waterproof container are joined to and removed from the first watercraft.

6. The system of claim 1 wherein the rudder and the rudder shaft are permanently installed in the first watercraft, the servo unit is mounted on the mounting plate, and the radio receiver/controller and a battery pack are provided in a waterproof container.

7. The system of claim 6 wherein the mounting plate and the waterproof container are joined to the deck area by conventional fasteners.

8. The system of claim 6 wherein the mounting plate, the waterproof container and the deck area have cut pieces of reusable fastener material adhered by adhesive, whereby the mounting plate with the servo unit and the waterproof container may be joined to and removed from the first watercraft.

9. The system of claim 1 further comprising a second water craft, wherein the user manipulating the radio controller follows the first watercraft while providing guidance signals to the first watercraft.

10. The system of claim 1 wherein the first watercraft is a rowing shell.

11. A method for guiding a first watercraft remotely, comprising:

connecting a servo horn of a servo unit to a rudder shaft connected to a rudder, the rudder shaft and rudder proximate a stern of the first watercraft, by a linkage adapted to turn the rudder shaft in concert with the servo horn;

sending guidance signals to a receiver/controller on the first watercraft from a radio controller having an input wheel, the radio controller operated by a user remote from the first watercraft; and guiding the first watercraft by sending operating signals to the servo unit from the receiver/controller.

12. The method of claim 11 further comprising mounting the rudder shaft, the rudder, and the servo unit joined to the rudder shaft by linkage, to a mounting plate, and placing the radio receiver/controller in a waterproof container also holding a battery pack as a power supply for the system, the waterproof container having an output port coupled by a three-wire cable to the servo unit, providing the operating signals to the servo unit, and mounting the mounting plate and the waterproof container to a deck area at the stern of the first watercraft.

13. The method of claim 12 wherein the mounting plate is a commercially available hinged mounting plate, further comprising mounting the rudder shaft, the rudder, and the servo unit joined to the rudder shaft by linkage, to the McMaster Carr™ mounting plate.

14. The method of claim 12 further comprising securing the mounting plate and the waterproof container to the deck area by conventional fasteners.

15. The method of claim 12 further comprising adhering, by adhesive, cut pieces of reusable fastener material to the deck area at the stern of the first watercraft and to the underside of both the mounting plate and the waterproof container, whereby the mounting plate and mounted elements and the waterproof container are joined to and removed from the first watercraft.

16. The method of claim 11 wherein the rudder and the rudder shaft are permanently installed in the first watercraft, further comprising mounting the servo unit on the mounting plate and placing the radio receiver/controller and a battery pack in a waterproof container.

17. The method of claim 16 further comprising joining the mounting plate and the waterproof container to the deck area by conventional fasteners.

18. The method of claim 16 further comprising joining cut pieces of reusable fastener material to the mounting plate, the waterproof container and the deck area by adhesive, and joining and removing the mounting plate with the servo unit and the waterproof container from the first watercraft.

19. The method of claim 11 further comprising a second water craft, further comprising the user manipulating the radio controller providing guidance signals to the first watercraft while following the first watercraft in the second watercraft.

20. The method of claim 11 wherein the first watercraft is a rowing shell, comprising guiding the rowing shell for a sight-challenged person operating the rowing shell.

* * * * *